United States Patent [19]

Rasmussen

[11] Patent Number: 4,712,461

[45] Date of Patent: Dec. 15, 1987

[54] ROLLED MATERIAL DISPENSER WITH FEED ROLLER CONTAINING A SLIDING CUTTER

[75] Inventor: Holger Rasmussen, Kilchberg, Switzerland

[73] Assignee: Georgia-Pacific Corporation, Atlanta, Ga.

[21] Appl. No.: 788,837

[22] Filed: Oct. 18, 1985

[51] Int. Cl.[4] ..... A47K 10/36; B26D 1/56; B26F 3/02

[52] U.S. Cl. ..... 83/334; 83/337; 83/649; 225/106

[58] Field of Search ..... 225/96, 106; 83/318, 83/334, 338, 339, 347, 674, 649, 650

[56] References Cited

U.S. PATENT DOCUMENTS

| | | | |
|---|---|---|---|
| 1,969,480 | 8/1934 | Shipley | 83/337 |
| 2,512,900 | 6/1950 | Kwitek | 242/56.6 |
| 2,769,600 | 11/1956 | Kwitek et al. | 242/56.6 |
| 3,342,434 | 9/1967 | Conrad, Jr. | 242/56 |
| 4,188,844 | 2/1980 | DeLuca | 83/337 |
| 4,213,363 | 7/1980 | Granger | 83/337 |
| 4,276,797 | 7/1981 | Baumann et al. | 83/308 |
| 4,339,092 | 7/1982 | Benoy et al. | 83/337 |

FOREIGN PATENT DOCUMENTS

| | | | |
|---|---|---|---|
| 0145622 | 7/1985 | European Pat. Off. . | |
| 0157713 | 10/1985 | European Pat. Off. . | |
| 1196837 | 11/1959 | France | 83/674 |
| 357619 | 11/1961 | Switzerland | 83/337 |
| 678029 | 8/1952 | United Kingdom . | |
| 1482193 | 8/1977 | United Kingdom | 83/337 |

*Primary Examiner*—Paul A. Bell
*Assistant Examiner*—Hien H. Phan
*Attorney, Agent, or Firm*—Banner, Birch, McKie & Beckett

[57] ABSTRACT

A dispenser for rolls of flexible sheet material has a feed roller with a pair of pinch rollers spaced around the feed roller periphery to guide a web of the material from a supply roll to the dispenser exit. A cutting blade is slidably mounted within the feed roller to move in a path parallel to and offset from a radius of the feed roller with cam followers movable with the blade and extending beyond the ends of the feed roller disposed to reciprocate along this radius. Stationary cams are mounted adjacent the ends of the feed roller engaged with the cam followers, respectively, to positively project the blade cutting edge beyond the feed roller periphery to cut the web and retract such edge as the feed roller is rotated by drawing on the web at the dispenser exit.

5 Claims, 6 Drawing Figures

ROLLED MATERIAL DISPENSER WITH FEED ROLLER CONTAINING A SLIDING CUTTER

BACKGROUND OF THE INVENTION

This invention relates to rolled material dispensers and, more specifically, to a flexible sheet material dispenser such as usable for dispensing paper towels with a cutter mechanism housed within the feed roller of the dispenser adapted to cut a web of flexible sheet material into individual lengths of the material.

Dispensers for rolled flexible sheet material, such as paper toweling, are well known, a great many of such dispensers including mechanisms for perforating or severing a web of the material to divide the web into individual sheets. The perforating or severing mechanism used in a number of these dispensers has included a rotatably mounted knife and a cooperating rotatably mounted roller having a slot therein for receiving the radially outermost portion of the knife as the knife rotates past the roller. A web of flexible sheet material is passed between the roller and the knife to be perforated or severed when the radially outward knife portion enters the slot in the roller.

Such mechanisms are satisfactory for perforating or severing relatively unstretchable flexible sheet materials, such as uncreped paper toweling. However, with the increased use of relatively stretchable flexible sheet materials, such as embossed or creped paper toweling, the prior art perforating and severing mechanisms have proved unsatisfactory because the web of sheet material tends to stretch about the cutting edge of the knife instead of being effectively perforated or severed thereby.

Although precision rotary shears are known which could be employed to overcome this problem, such shears are much too expensive to be used in flexible sheet material dispensers designed for installation to be used in both commercial and private washrooms.

Various devices for cutting off sheets of creped web material have been proposed. One is exemplified in DeLuca U.S. Pat. No. 4,188,844 issued Feb. 19, 1980, wherein a toothed knife is pivotally mounted internally of the feed roller within the towel dispenser. However, the towel cut produced by these internal pivoted toothed knives produces a wavy shape due to the pivoting action which the toothed knife undergoes. The points and roots of the straight knife teeth do not emerge from the feed roller on a straight line. Where the cutting knife is mounted to be movable radially outwardly from within a roller over which a web of paper is passing, this radially movable cutting knife unduly stretches the paper away from the feed roller without properly cutting the web.

In dispensers for crepe paper toweling where the cutting mechanism is intended to be actuated solely by pulling on the paper web, usually with the web hands of the intending user, it is important that the required pulling force be minimized to prevent the web from tearing prematurely in the intending user's fingers. To minimize the tearing effort, the cut must be as short as possible and hence must be 90° to the length of the web of sheet material and without a wave form at the location of the web cut. In dealing with crepe paper toweling, the cutting mechanism must also be designed such that the cutting mechanism will effectively cut the paper with a minimum of paper movement and not significantly stretch the creped paper.

SUMMARY OF THE INVENTION

The rolled material dispenser of this invention is designed to dispense predetermined lengths of creped paper from a supply roll of toweling material employing a cutting mechanism operable solely by pulling on the free end of the paper web exposed at the dispenser exit. The web is cut into predetermined lengths with the cut being made at 90° to the length of the towel web, the cut being free of waves and the cut being made with a minimum of pulling effort required to be applied to the free web end.

The rolled material dispenser of this invention overcomes the objections discussed above with reference to prior art proposals in dispensing crepe paper toweling by using a straight sliding knife mounted inside a feed roller having a high friction exterior surface. The mounting for the slidable cutting blade assures movement of the blade in a path parallel to and offset from a radius of the feed roller. Sliding the knife blade in and out of the feed roller along the same plane as the plane of the knife teeth serves to assure the completion of a perfectly straight cut. By having the plane of the knife offset from a radius of the feed roller, the cutting blade emerges with the knife moving forward in the same direction as the rotation of the feed roller to allow the blade teeth to penetrate the towel web without unduly stretching it away from the feed roller.

Reciprocating movements are imparted to the cutting blade as the feed roller is rotated by drawing on the web of material exposed at the dispenser exit by providing cam followers movable with the blade. These cam followers extend beyond the ends of the feed roller and are disposed to reciprocate along the radius of the feed roller from which the cutting blade is laterally offset. Stationary cams are mounted adjacent the ends of the feed roller engaged with the cam followers, respectively, to positively project the blade cutting edge beyond the feed roller periphery to cut the web and positively retract such edge as the feed roller is rotated by drawing on the web at the dispenser exit.

With the foregoing in mind, it is an object of the present invention to provide a flexible sheet material dispenser well suited to the handling of creped paper toweling wherein the mechanism for effectively cutting the toweling web makes a straight cut perpendicular to the length of the web while cutting the web into predetermined lengths as needed for intending towel users.

It is also an object of the invention to provide a dispenser including a cutting blade slidably mounted within the dispenser feed roller wherein the cutting edge of the blade is projected outwardly beyond the periphery of the feed roller along a path parallel to and offset from a radius of the feed roller to cut the web as it passes over the feed roller.

It is a further object of the invention to provide a flexible sheet material dispenser wherein a cutting blade is slidably mounted within a feed roller and stationary cams external of the feed roller operate to positively project and retract the cutting blade incident rotation of the feed roller as the towel web is withdrawn from the dispenser exit by an intending user.

An additional object of the invention is to provide a rolled material dispenser for effectively making a straight cut perpendicular to the web of material being withdrawn from the dispenser which is compact, rugged and economical to manufacture and ideally suited for both commercial and private installations.

These and other objects of the invention will become apparent upon consideration of the detailed description of a preferred embodiment of the invention in connection with the accompanying drawings.

DESCRIPTION OF THE PREFERRED EMBODIMENT

Figure 1:
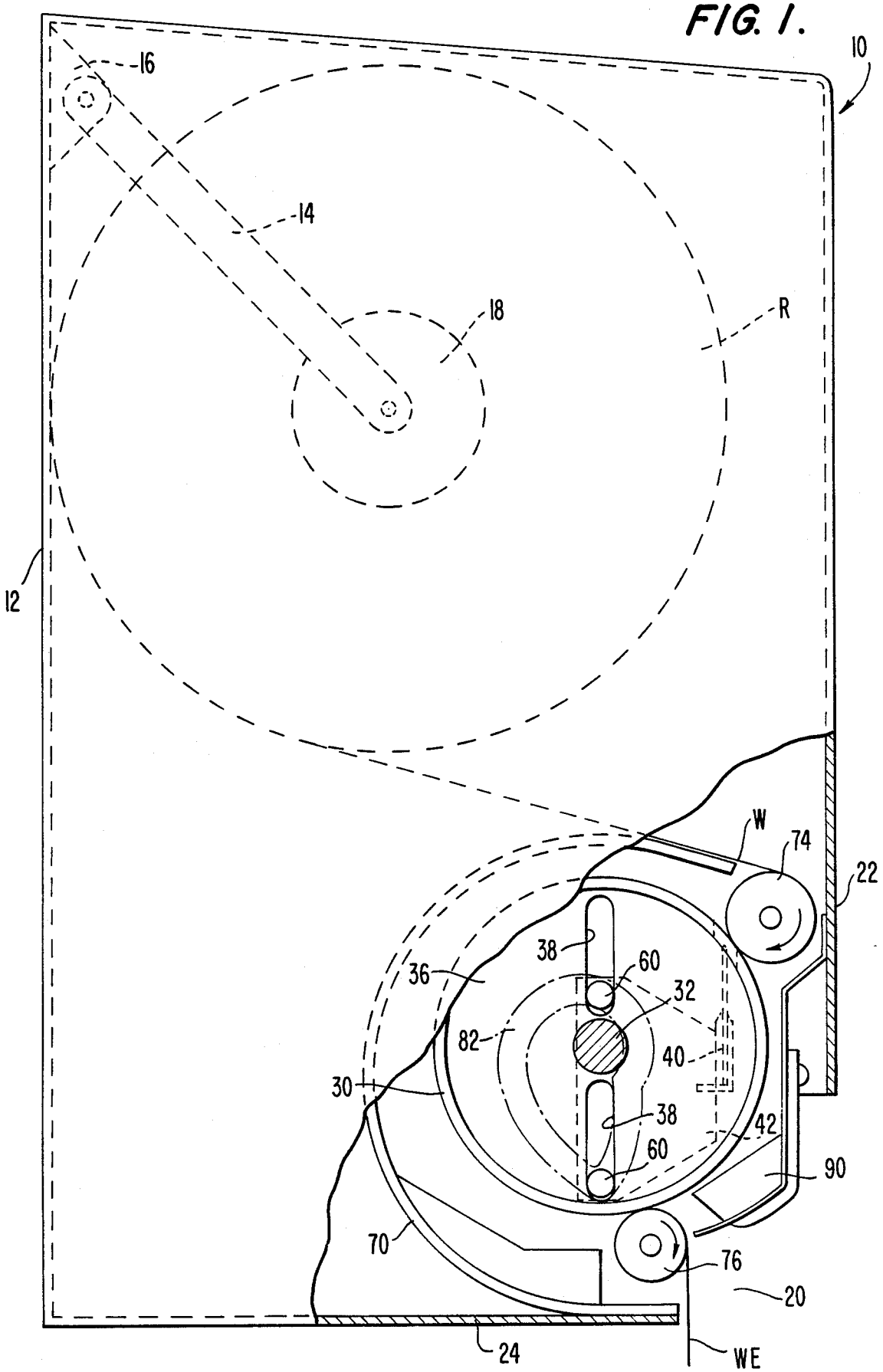
FIG. 1 is a side elevational, view with portions in section, of the rolled material dispenser of this invention displaying the feed roller containing a sliding cutter.

Referring to FIG. 1 on the drawings, the general outline of a fairly conventional dispenser cabinet chassis 10 is illustrated. The dispenser chassis 10 has a back wall 12 which will be provided with appropriate openings (not shown) to accommodate fasteners for attaching the chassis 10 of the dispenser to a wall.

A main supply roll R of flexible sheet material, such as paper toweling, may be suitably supported on a yoke 14 having its legs pivotally connected to clips 16 fixedly secured to the back wall 12 of dispenser chassis 10. The legs of yoke 14 each carry a cup 18 at their free ends, these oppositely facing cups 18 entering into the opposite ends of the core of supply roll R such that roll R rests against the back wall 12, moving downwardly as towel material is withdrawn from the roll. This mounting for a supply roll R within a dispenser chassis 10 is fairly conventional in the rolled material dispenser art and further discussion of such structure should be unnecessary.

Further, generally well known features for the dispenser chassis 10 may include the front portion consisting a cabinet cover pivoted to the back wall 12 of chassis 10 to enable this cover to be opened for successive reloading of fresh rolls R onto yoke 14 in the chassis 10. An opening 20 at the lower front portion of chassis 10 provides the dispenser exit as by the front wall 22 of the cover of chassis 10 terminating above the bottom wall 24 of chassis 10.

The web W of flexible sheet material withdrawn off supply roll R is threaded into the dispensing and cutting mechanism mounted within the chassis 10 which may now be described in detail.

Referring to FIGS. 1–4, a feed roller 30 is rotatably mounted don stub shafts 32 extending axially outwardly from the opposite ends of feed roller 30. Each stub shaft 32 has one end thereof fixedly securing a central bore 34 in the hub 36 of feed roller 30, this structure being best seen in FIG. 3.

The outer end of one of the stub shafts 32 may be provided with the conventional hand wheel (not shown) fixedly secured thereto, this hand wheel enabling manual rotation of the feed roller 30 from a point externally of the dispenser chassis 10 should such manual rotation of feed roller 30 be necessary as in threading the web W of flexible sheet material from supply roll through the dispensing and cutting mechanism to the dispenser exit 20.

Each of the feed roller hubs 36 is formed with a pair of slots 38 aligned along a diameter of the feed roller. These pairs of slots in the hubs 36 at the opposite ends of the feed roller 30 form part of the mounting means for the carrier supporting the cutter blade as will be described subsequently.

A carrier for cutting blade 40 is provided by a pair of plates 42. One plate 42 is fixedly mounted on each end of the cutting blade 40 with these plates 42 being perpendicular to the length of blade 40.

Figure 6:
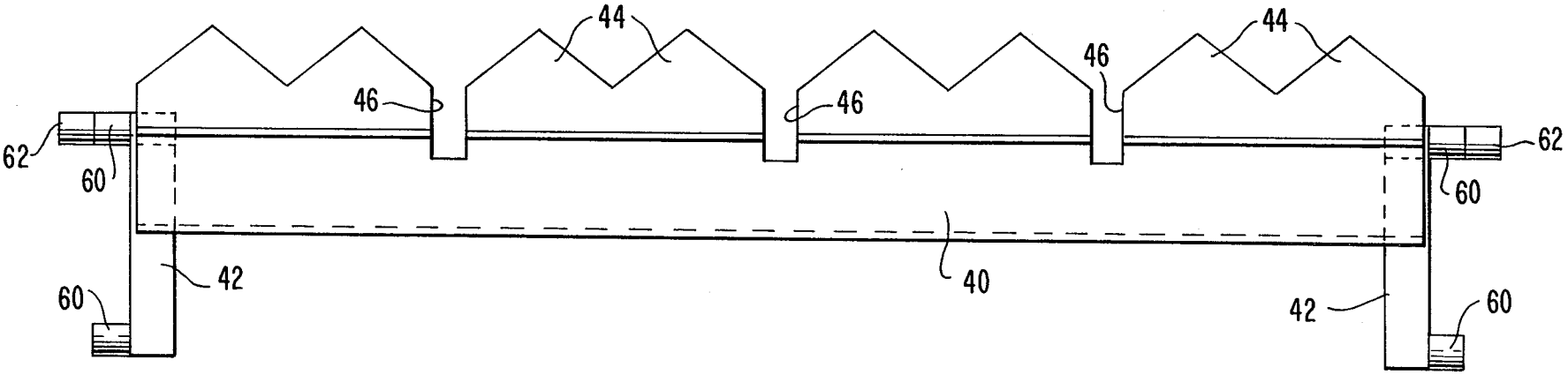
FIG. 6 is an elevational view of the cutting blade for the feed roller interior.

As may be best seen in FIG. 6, the blade 40 with the carrier provided by plates 42 at the opposite ends of the blade 40 is formed with a series of teeth 44 spaced along the length of blade 40. In the specific embodiment illustrated, four pairs of teeth 44 are provided along the length of blade 40 with these pairs of teeth 44 being separated by recesses 46.

Figure 5:
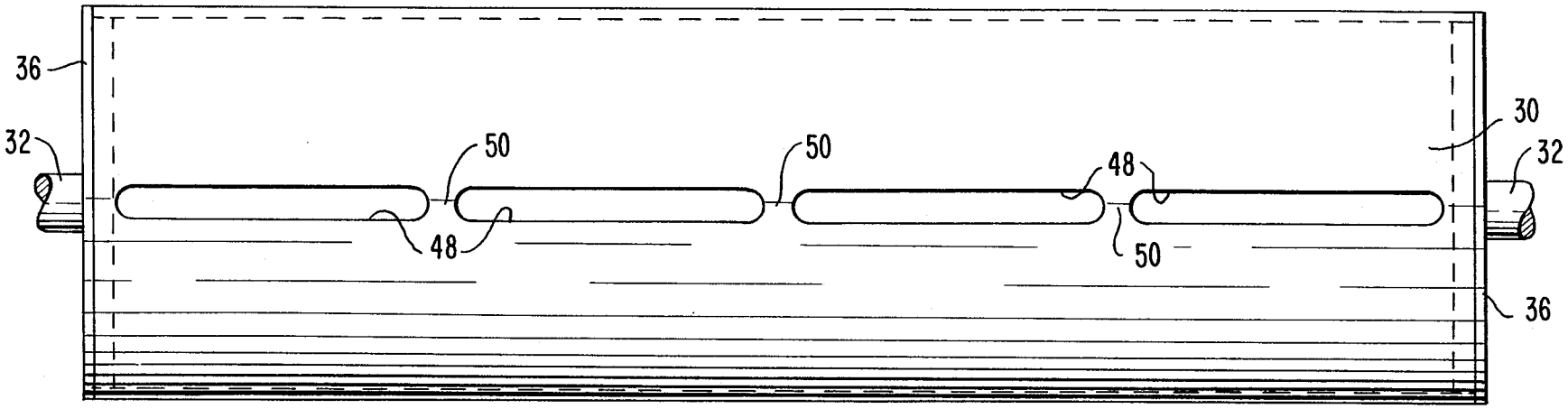
FIG. 5 is a side elevational view of the feed roller showing the longitudinal aperture means.

As will be seen from FIG. 5, the periphery of feed roller 30 is provided with aperture means consisting of a series of longitudinally aligned slots 48, four such slots being shown in the illustrated embodiment on FIG. 5 with these slots being separated by continuous surface portions 50 which are part of the peripheral surface of feed roller 30.

In the mounting of cutting blade 40 within feed roller 30 as will be more apparent hereinafter, the pairs of teeth 44 on blade 40 separated by recesses 46 are projected outwardly through the four aligned slots 48 of feed roller 30 while the solid portions 50 of the feed roller periphery pass down into the three recesses 46. By utilizing this form of cutting blade 40 with the particular aperture means provided by slots 48 in the periphery of feed roller 30, the cutting action performed on the web of flexible sheet material passing over the feed roller 30 produces a straight line cut parallel with the axis of feed roller 30 but leaving three small uncut portions in the web corresponding to the width of recesses 46 and length of solid portions 50 on the periphery of feed roller 30.

By leaving these minor uncut portions of the web W, spaced across the width of the web, the continuity of web W is maintained while the web has been substantially cut but is still within the confines of the dispenser chassis 10 before reaching the dispenser exit 20. Once the web is pulled further from the dispenser chassis 10 by the intending user of the now defined sheet length, a minor degree of pulling force applied by the intending user will easily separate the spaced uncut portions left by the configuration of cutting blade 40 and spaced slots 48 in feed roller perphery 30 with the intending user effectively obtaining the appropriate length of toweling.

Each of the carrier plates 42 fixedly mounted on the opposite ends of cutting blade 40 is provided with a pair of a guide pins 60 extending normal to the plane of plate 42. These pins 60 are spaced on each plate 42 to be positioned to guidingly engage with the aligned slots 38 formed in each hub 36 at the ends of feed roller 30. With this mounting means for the carrier plates 42 fixed to the ends of elongated cutting blade 40, the cutting blade 40 is reciprocable in a path which is parallel to and laterally offset from a radius of the feed roller, this radius corresponding to the axis of the aligned slots 38 which extend along a diameter of feed roller 30. Thus, not only does the mounting means enable movement of the cutting blade in a path parallel to and laterally offset from this radius of feed roller 30 but also the mounting means provides for reciprocation of the guide pins 60 along this same radius of the feed roller 30.

One of the guide pins on each of the carrier plates 42 at the ends of cutting blade 40 is provided with a cam follower 62. This cam follower 62 at each end of feed roller 30 extends outwardly beyond the ends of feed roller 30 as may be best seen on FIG. 3. Thus, while the guide pins 60 on each carrier plate 42 are basically enclosed within the pair of aligned slots 38 in the hub 36 at each end of roller 30, the cam follower 62 extends outwardly beyond the feed roller end to engage with a stationary cam mounted on the dispenser chassis as will be described subsequently.

Within the lower forward portion of dispenser chassis 10, immediately adjacent the dispenser exit 20, there is provided a suitable casing to house the feed roller and other components making up the dispensing and cutting mechanism. The location of this casing within the dispenser chassis 10 is shown in FIG. 1 while its components may generally be seen in the sectional view of FIG. 3.

The casing includes a semi-cylindrical housing 70 having an internal diameter somewhat larger than the diameter of feed roller 30. Housing 70 extends from the point where the web W of flexible sheet material enters the dispensing and cutting mechanism, terminating adjacent the dispenser exit 20. The housing 70 extends across the width of the dispenser chassis 10 between the sides of the pivotally mounted cover of dispenser chassis 10. Housing 70 may have its ends closed by end plates 72, one such plate being disposed at each end of housing 70 with the plate 72 appropriately secured to the end of housing 70 in the relation as shown in section on FIG. 3.

Within the casing made up by semi-cylindrical housing 70 and the two end plates 72 closing the ends of such housing, there is provided a lead-in pinch roller 74. Preferably, this pinch roller is mounted on a shaft is biased by spring means (not shown) against the peripheral surface of feed roller 30. A second pinch roller 76 is mounted, similar to the mounting for pinch roller 74, with pinch roller 76 being disposed immediately adjacent the dispenser exit 20. Thus, pinch roller 76 will be spring biased by means (not shown) against the peripheral surface of feed roller 30 similar to pinch roller 74.

The path of the web W of flexible sheet material coming from supply roll R as it moves through the dispensing and cutting mechanism may now be described. After leaving roll R carried on pivotally supported yoke 14 the web W initially passes clockwise around the pinch roller 74 as viewed on FIGS. 1, 2 and 4. Web W then proceeds counterclockwise around the high friction peripheral surface of feed roller 30. The presence of semi-cylindrical housing 70 which generally concentrically encloses feed roller 30 serves to guide and thereby assist in threading the leading end of web W around the back side of feed roller 30 within dispenser chassis 10. Then the web W passes clockwise over the second pinch roller 76 whereafter the web exits through dispenser exit 20 to be readily available externally of the dispenser chassis 10 for an intending user of the toweling material.

To effect positive reciprocation of the cutting blade 40 and thereby project the cutting teeth 44 forming the cutting edge beyond the periphery of feed roller 30 through the aperture means provided in the feed roller periphery by slots 48 to cut the web and thereafter retract the cutting edge as the feed roller rotates, stationary cams are mounted on the dispenser chassis 10 adjacent the ends of feed roller 30. These stationary cams in the illustrated embodiment are provided by a cam plate 80 having a cam track 82 formed therein. As may be seen from FIG. 3, the cam plate 80 is disposed within the semi-cylindrical housing 70 disposed in abutment with the end plate 72. It will be understood that a similar cam plate 80 with similar cam track 82 formed therein will be disposed at the opposite end of semi-cylindrical housing 70 and end plate 72 at the other end of feed roller 30.

The cam follower 62 disposed in alignment with the guide pin 60 at the upper end of the carrier plate 42 for cutting knife 40 is engaged within the cam track 82 of cam plate 80. The configuration of the cam track 82 may be seen from the broken line showing for the cam track on FIGS. 1, 2 and 4.

To support the feed roller 30 on its stub shafts 32 within the casing provided by housing 70 and end plates 72, each cam plate 80 may be provided with a sleeve bearing 84 within which the stub shaft 32 is journaled. Such a structure is shown in FIG. 3 and it will be understood that a similar construction is repeated at the opposite end of feed roller 30 and associated cam plate 80.

A stripper bar 90 is shown in FIG. 1 fixed tot he front wall 22 of dispenser chassis 10. This front wall 22 as previously described may be the front of the cover forming a part of the dispenser chassis 10, such cover being pivotally mounted (not shown) on the back wall 12 of the dispenser chassis 10. The lower end of the stripper bar 90 which extends along the length of feed roller 30 is disposed closely adjacent the peripheral surface of feed roller 30 immediately in front of the exit pinch roller 76. The stripper bar 90 acts to ensure that the web of creped material is stripped from the high friction surface of the feed roller 30 and properly guided down along exit pinch roller 76 to the dispenser exit 20.

It has been described hereinabove how the web of creped material being unwound from supply roll R is threaded clockwise around pinch roller 74, then counterclockwise around the high friction surface of feed roller 30 and then clockwise around exit pinch roller 76. With web W so threaded and the dispensing and cutting mechanism in the position shown in FIGS. 1, 2 and 3, the cutting edge formed by teeth 44 on cutting blade 40 is retracted to lie within the periphery of feed roller 30. The cam follower 62 at the upper location of pin 60 on carrier plate 42 is engaged in the portion of cam track 82 which is closely adjacent to the axis of feed roller 30 defined by the supporting stub shafts 32. By applying a pulling force on web WE, web material withdrawn from supply roll R passes around lead-in pinch roller 74, thence around the high friction surface of feed roller 30 and finally around the exit pinch roller 76 leaving through dispenser exit 20 to the intending user.

Figure 2:
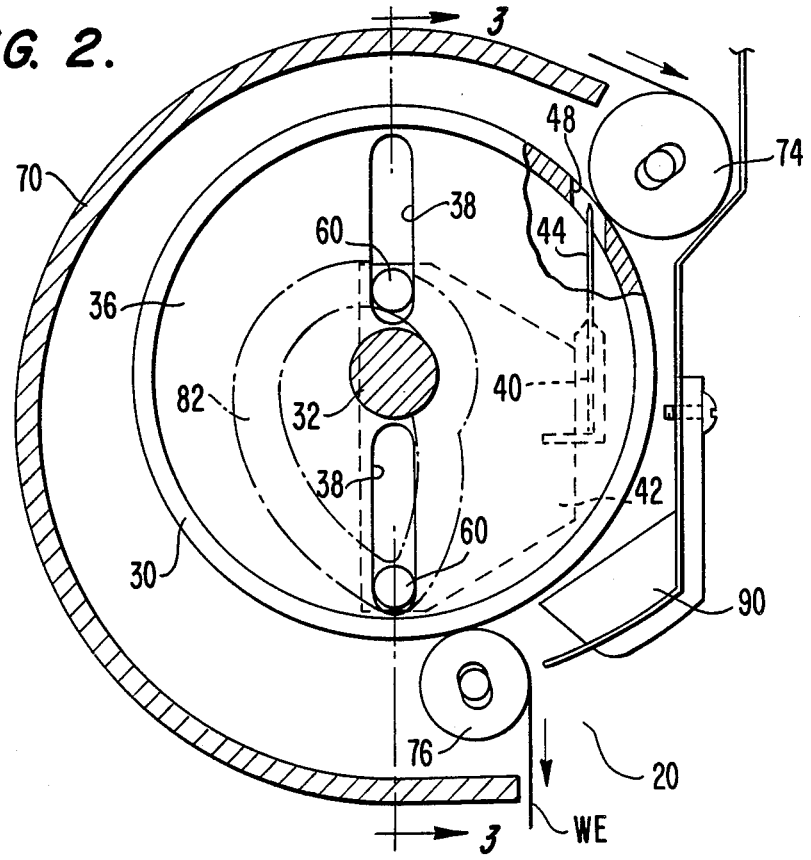
FIG. 2 is an enlarged sectional view of the feed roller containing the sliding cutter with a portion of the feed roller broken away.
Figure 3:
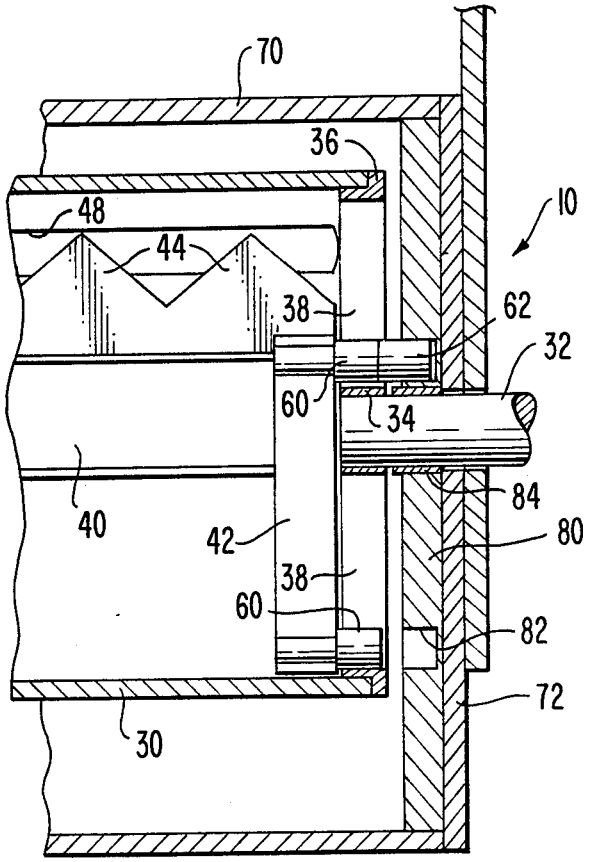
FIG. 3 is a sectional view taken on line 3—3 of FIG. 2.
Figure 4:
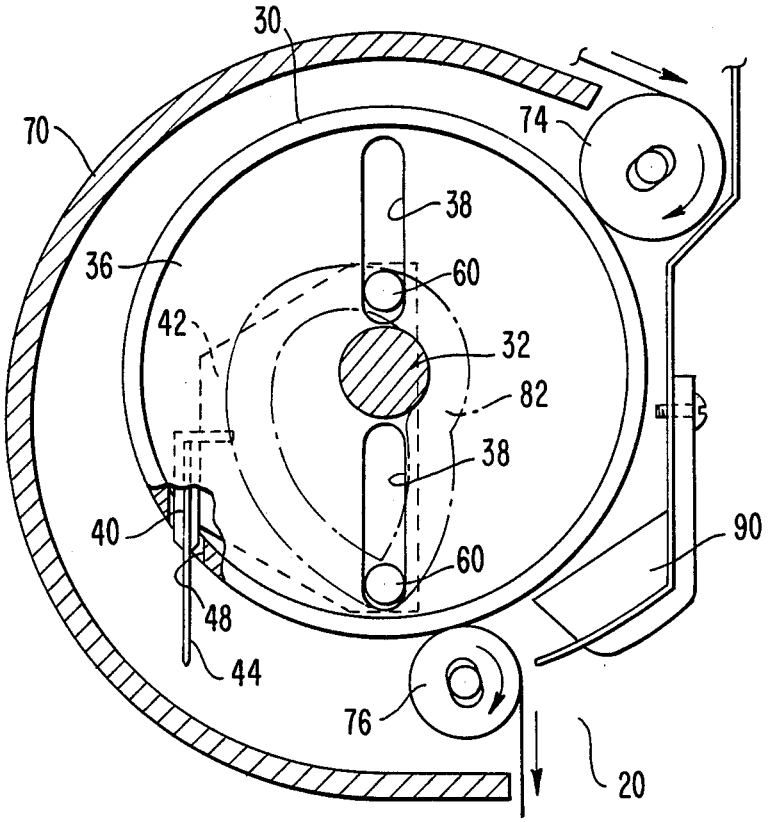
FIG. 4 is a view similar to FIG. 2 but showing the feed roller and sliding cutter rotator to a different operated condition.

As web material is pulled out of the dispenser, the feed roller 30 is caused to rotate resulting in the cam followers 62 moving counterclockwise as shown in FIGS. 1—3 around the path of cam tracks 82. This continued rotation of feed roller 30 moves the cam followers 62 which were disposed at the uppermost position in cam tracks 82 in FIGS. 1 and 2 until these cam followers have progressed to the lowermost position within cam tracks 82 as shown in FIG. 4. During this course of 180° rotation of feed roller 30, the cutting edge on knife 40 provided by teeth 44 will have progressed from being within the periphery of the feed roller 30 to a position where the cutting edge of teeth 44 is fully projected as shown in FIG. 4. During this 180° of rotation while the cutting edge of teeth 44 is projected through the aligned slots 48 in the periphery of feed roller 30, the web will have been cut subject only to leaving small uncut portions defined by the recesses 46 in knife 40 cooperating with the solid portions 50 which separate the aligned slots 48.

Continued withdrawal of web material will produce further rotation of feed roller 30 with the cam followers 62 commencing to move up within the cam tracks 82 of cam plates 80 thereby rapidly retracting the cutting edge of teeth 44 on cutting blade 40 back within the feed roller 30 such that when the aperture means provided by slots 48 reach the tangent line between feed roller 30 and exit pinch roller 76, the cutting edge teeth 44 of knife 40 will have been fully retracted back within the feed roller 30. This fully retracted position for knife 40 will continue as the cam followers 62 travel along the remaining path of cam tracks 82 and until the aperture means provided by slots 48 reach the contact line between feed roller 30 and pinch roller 74, this position being known for knife 40 on FIGS. 1 and 2.

At this stage the intending user may readily separate the three small uncut portions left by recesses 46 in knife 40 thereby being made available a predetermined length of creped material. At the same time, a free length of web end WE will remain available, disposed beneath the dispenser exit 20 in readiness for the next intended use of towel material. Of course, the above described procedure in operating and dispensing and cutting mechanism may be repeatedly carried out thereafter, continued to the extent of toweling desired by intending users.

It should be noted that due to the laterally offset location of the cutting blade 40 relative to a radius of feed roller 30, the cutting edge of the blade emerges from the interior of the feed roller in the direction of feed roller rotation. The friction coated surface of the feed roller behind the blade cutting edge holds the creped web material thus minimizing stretch in the towel paper as the knife penetrates the web, thereby permitting positive cutoff of the web with a minimum travel of the cutting blade.

The foregoing sets forth a detailed description of the rolled material dispenser and cutting mechanism of the invention. It is to be recognized that various modifications of the dispenser and cutting mechanism of this invention will become apparent to those skilled in the art. Therefore, the scope of the invention is to be limited solely by the scope of the appended claims.

I claim:

1. A dispenser for rolls of flexible sheet material comprising:

a chassis adapted to be attached to a wall;

means carried by said chassis for rotatably supporting a roll of flexible sheet material;

a feed roller rotatably mounted on said chassis for guiding a web of sheet material from the roll to a position to be grasped by a user so that the user may pull the web out of the dispenser, said feed roller having aperture means formed longitudinally in the periphery thereof;

carrier means within said feed roller having a cutting blade mounted thereon and cam followers extending beyond the opposite ends of said feed roller, said blade having a cutting edge;

means mounting said carrier means in said feed roller for movement of said cutting blade in a flat plane along a linear path parallel to and laterally offset from a radius of said feed roller; and means including statinary cams mounted on said chassis adjacent the ends of said feed roller, respectively, said cam followers being engaged with said stationary cams to move said blade in said path projecting said cutting edge beyond said feed roller periphery through said aperture means to cut the web and retracting said edge as said feed roller rotates.

2. A dispenser as recited in claim 1 wherein said carrier means includes a pair of plates, one said plate being fixedly mounted on each end of said cutting blade perpendicular to the length of said blade, and said mounting means supports said carrier means by means of said plates.

3. A dispenser as recited in claim 2 wherein said mounting means includes a pair of slots aligned along a diameter of said feed roller at each end of said roller, said slots being aligned with said radius, and each of said plates is provided with a pair of guide pins extending normal to the plane of the plate with the pair of pins on each plate being guidingly engaged with the aligned slots in one end of said feed roller.

4. A dispenser as recited in any one of claims 1 or 2 wherein said mounting means provides for reciprocation of said cam followers along said radius of said feed roller.

5. A dispenser as recited in claim 4 wherein said mounting means includes guide means cooperating with said carrier means and the ends of said feed roller to constrain reciprocating movements of said carrier means to the direction of said radius.

* * * * *